United States Patent [19]

Pettersson

[11] Patent Number: 4,496,299

[45] Date of Patent: Jan. 29, 1985

[54] UNIT CONTAINING A MOULDING TOOL FOR SEMI-ISOSTATIC COMPACTION OF A POWDER CONTAINED IN THE PRESS TOOL CAVITY

[75] Inventor: Ola Pettersson, Vipvägen, Sweden

[73] Assignee: KB Cold Isostatic Press Systems CIPS, Hoganas, Sweden

[21] Appl. No.: 548,002

[22] Filed: Nov. 2, 1983

[30] Foreign Application Priority Data

Nov. 18, 1982 [SE] Sweden ..... 8206586

[51] Int. Cl.[3] ..... B30B 5/02

[52] U.S. Cl. ..... 425/405 H; 72/63; 264/109; 264/314; 264/DIG. 50; 425/78; 425/DIG. 19; 425/DIG. 44

[58] Field of Search ..... 264/314, 315, DIG. 50, 264/109; 425/78, 405 H, 417, 419, DIG. 14, DIG. 19, DIG. 44; 72/63; 249/65

[56] References Cited

U.S. PATENT DOCUMENTS

| | | | |
|---|---|---|---|
| 3,184,528 | 5/1965 | Norwalk | 425/405 H |
| 3,832,103 | 8/1974 | Bowles | 425/DIG. 44 |
| 3,897,531 | 7/1975 | Overhoff et al. | 264/314 |
| 4,046,499 | 9/1977 | Saito | 425/DIG. 44 |
| 4,056,347 | 11/1977 | Trolle | 425/78 |
| 4,097,977 | 7/1978 | Pollner | 425/405 H |

FOREIGN PATENT DOCUMENTS

| | | | |
|---|---|---|---|
| 2089711 | 6/1982 | United Kingdom | 425/405 H |

*Primary Examiner*—Jay H. Woo
*Assistant Examiner*—Joye L. Woodard
*Attorney, Agent, or Firm*—Burns, Doane, Swecker and Mathis

[57] ABSTRACT

A moulding tool unit for semi-isostatic compaction of a powder has a mould cavity (14) defined by an elastomeric jacket (121). The jacket (121) is surrounded with clearance by an elastomeric sleeve (122) which is sealingly joined to the jacket (121). The space (123) between the sleeve (122) and jacket (121 ) is filled with an isostatic pressure translating medium such as a hydraulic liquid (127). The jacket (121) may be supported in a direction towards the sleeve (122) by a stiff jacket (125) having perforations (126) through which the hydraulic liquid (127) can flow. The unit is adapted such that for a pressing operation it can be inserted with a small clearance and pressurized in the dry pressing chamber of a hydraulic press.

7 Claims, 5 Drawing Figures

UNIT CONTAINING A MOULDING TOOL FOR SEMI-ISOSTATIC COMPACTION OF A POWDER CONTAINED IN THE PRESS TOOL CAVITY

TECHNICAL FIELD

The invention relates to a unit containing a moulding tool for semi-isostatic compaction of a powder contained in the cavity of the tool, this cavity being defined by an elastomeric jacket. The unit is adapted such that for a pressing operation it can be inserted into a dry hydraulic pressing chamber and pressurized there, there being a hydraulically expandable chamber behind the wall of the chamber.

BACKGROUND ART

In isostatic or semi-isostatic compaction of powder into solid bodies, a mould is utilized which is at least partially defined by an elastomeric wall, which defines a mould cavity for filling with the powder. According to the so-called dry-bag technique, the elastomeric wall is an expandable chamber wall in a hydraulic press containing a hydraulic chamber behind the wall. The mould thus forms a part of the press itself. Accordingly, the press is inactive when the mould is being filled with powder and when the compacted product is removed. Since the press itself is burdened with large costs, it is extremely important to utilize it as intensively as possible.

According to the so-called wet-bag technique, the pressing chamber of the press is wet, the mould being removable from the press for being filled with powder and being relieved of the compacted product outside the press. However, there is the disadvantage that the hydraulic liquid of the press contaminates the mould and surroundings and can be contaminated by the powder.

It has therefore also been proposed to combine the wet-bag technique and the dry-bag technique. For this the pressing chamber is implemented as a dry cylindrical hydraulic pressure chamber having one end wall constituting an end wall of the mould. The mould is then made as a unit formed by a closure for the open end of the press and an elastomeric jacket which substantially isostatically translates the pressure from the expandable pressing chamber wall to the enclosed powder. It is then essential that the mould jacket consists of an elastomer capable of substantially isostatically translating the pressure to the enclosed powder. However, the elastomeric jacket of the mould must also have satisfactory stability of shape during filling with the powder or granules. This is usually achieved by manufacturing the elastomeric jacket with a comparatively large wall thickness from a material with a relatively large shore hardness. The result of this is that large elastic return forces are developed by the jacket when pressure is unloaded at the termination of the pressing operation. Apart from the possibility of these forces causing damage to the compacted body, we have also found that a thick and hard elastomeric jacket for the moulding tool can result in form deviations of the compacted product. It is possible that these form deviations are the result of the elastomeric jacket, at the end of the compacting operation, nonuniformly returning to its original shape in different partial areas, such that the contact pressure remains in some partial areas while it has been released from others in the compacted body.

It is indeed known, e.g. from the Swedish published specification No. 361 008, to avoid injurious rebound forces of the elastomeric jacket at the end of the compacting operation by making the jacket thin-walled and supporting it with the aid of a porous elastomeric foam through which the hydraulic fluid of the press can pass for coming into contact with the impermeable elastomeric jacket. However, this known art has nothing to offer in respect of the inventive technique, according to which the mould is to be arranged as a unit for coaction with a dry hydraulic press chamber.

One object of the invention is therefore to provide a press tool unit intended for coaction with a dry pressing chamber in a hydraulic press for semi-isostatic compaction of a powder enclosed in the mould cavity, in which the drawbacks of form deviation of the kind mentioned have been avoided.

A further object is to provide a mould unit of the kind mentioned, which may contain a plurality of form cavities for simultaneous compaction of a plurality of products during one working stroke of the press.

SUMMARY OF THE INVENTION

The inventive moulding tool unit includes, apart from a relatively thin elastomeric jacket which defines the mould cavity, a sleeve which surrounds the jacket with clearance and is sealingly connected to it, there also being an isostatic pressure translating medium enclosed between the jacket and sleeve. The unit furthermore includes a bottom slab carrying the elastomeric jacket such as to form with it a bowl-shaped mould cavity which may be filled by the powder. To advantage, the pressing chamber can be made as an upturned bowl, the bottom of which forms the end wall of the open end of the mould, when the unit is inserted in the press. The bottom slab of the mould may possibly be made as a closure for the bowl-shaped pressing chamber of the hydraulic press.

Furthermore, the bottom slab of the moulding tool unit can support a mandle or core extending centrally in, and coaxial with the unit, e.g. when hollow cylindrical products are to be produced.

A stiff perforated jacket may be arranged between the elastomeric jacket and the sleeve, the stiff jacket supporting the elastomeric jacket during the powder filling operation. If the pressure translating medium is a hydraulic fluid in this case, the liquid may flow through the perforations in the stiff jacket and isostatically translate the pressure generated by the press to the elastomeric jacket, which in turn isostatically translates the hydraulic pressure to the powder.

In the embodiment of the invention where no stiff, perforated jacket is utilized for supporting the elastomeric jacket, the isostatic pressure-translating medium may consist of an elastomer with relatively low hardness.

The expandable hydraulic chamber wall of the press can to advantage consist of an elastomer, as with the sleeve of the moulding tool unit.

By the unit wall containing an isostatic pressure translation medium, the elastomeric jacket may be placed spaced from the peripheral surface of the unit. A plurality of elastomeric jackets may be arranged in the unit in this way, these jackets being surrounded with clearance by a sleeve and sealingly connected thereto, an isostatic pressure translating medium filling the space between sleeve and elastomeric jackets. This means that a plurality of compacted powder bodies can be produced simultaneously in a single mould during a single working stroke of the press.

The invention, which is defined in the appended patent claims, will now be described in detail in the form of an embodiment and with reference to the accompanying drawing.

DRAWING

FIG. 1 schematically illustrates an axial section through an isostatic press with a moulding tool unit inserted for isostatic compaction of powder material, with which the moulding cavity of the unit has been filled.

EMBODIMENTS

Figure 1:
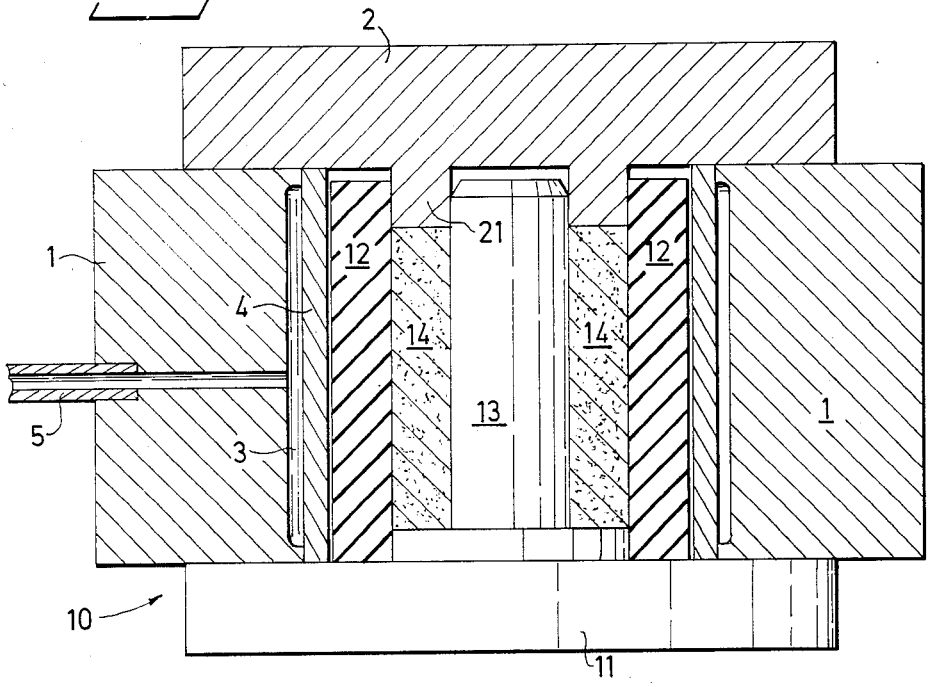
Fig. 1 PRIOR ART

A hydraulic press is illustrated in FIG. 1 and includes a hollow cylindrical jacket 1 with an end wall 2 rigidly mounted thereto, and an annular hydraulic chamber 3 behind the inner wall 4 of the press jacket 1. The hydraulic chamber 3 may be hydraulically pressurized or depressurized via a line 5.

A moulding tool unit 10 includes a base slab 11 pressing against the free end of the press jacket 1 for defining a closed pressing chamber for the press. The base slab 11 carries an elastomeric wall 12 and a central core 13. There is thus a hollow cylinder mould cavity 14 between the base slab 11, core 13 and elastomeric wall 12. The cavity 14 is filled with a compactable powder or granulate, e.g. iron powder. The mould cavity 14 is defined by an annular ridge 21 on the end wall 2, the ridge 21 extending down into the gap between the core 13 and the elastomeric wall 12. When the chamber 3 is put under hydraulic pressure, the wall 4 expands and exercises pressure against the elastomeric wall 12, which behaves as an isostatic pressure translating medium, so that the powder mass in the mould cavity 14 is subjected to an isostatic, or rather semi-isostatic compaction.

In order that the mould unit 10 may be filled with powder while there is satisfactory shape stability of the elastomeric wall 12, the latter must be relatively thick and have a comparatively great hardness. The embodiment in FIG. 1 may thus be regarded as illustrating the prior art.

Figure 2:
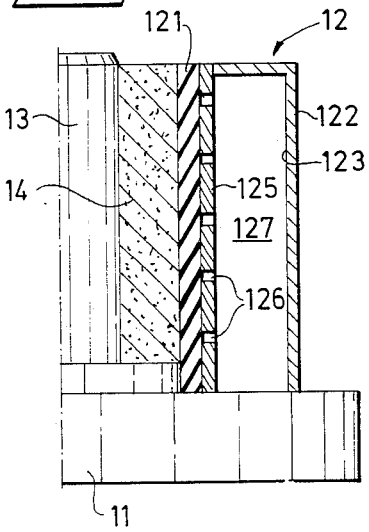
FIG. 2 is an axial section through a first embodiment of a unit in accordance with the invention.
Figure 3:
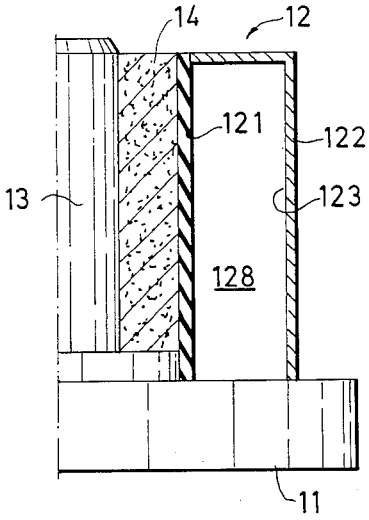
FIG. 3 is an axial section through a second embodiment of a unit in accordance with the invention.

To avoid the previously described drawbacks with a mould unit of the kind to be seen in FIG. 1, the moulding tool wall of the unit may be implemented according to the embodiment in FIG. 2 or 3.

A unit is illustrated in FIG. 2 comprising a base slab 11 carrying a central steel core 13 and a relatively thin elastomeric jacket 121, to which a sleeve 122 is sealingly connected. The sleeve 122 is arranged with clearance against the elastomeric jacket 121 to form a space 123 which is filled with a hydraulic fluid 127. In an unloaded state, the relatively thin elastomeric jacket 121 is supported by a stiff jacket 125 having perforations 126. The elastomeric jacket 121 rests loosely against the stiff jacket 125.

It will be seen from reference to FIG. 1 that the hydraulic pressurization of the chamber 3 will result in that the mould wall 4, which may consist of an elastomer, will bear against the sleeve 122 of the unit, this sleeve in turn pressurizing the hydraulic liquid 127 and forcing it through the perforations or slits 126 in the stiff jacket 125 so that the thin elastic jacket 121 exercises pressure against the powder in the mould cavity 14, the elastomer of the jacket 121 functioning as an isostatic pressure translation medium. The elastomeric jacket 121 may be selected thin, such that the previously described drawbacks are substantially avoided. It will be understood that the distance between the outside of the sleeve 122 and the hydraulic fluid 127 in the mould wall of the unit passes the pressure generated by the press to the powder cavity without generating any return force at the termination of the pressing operation.

Figure 4:
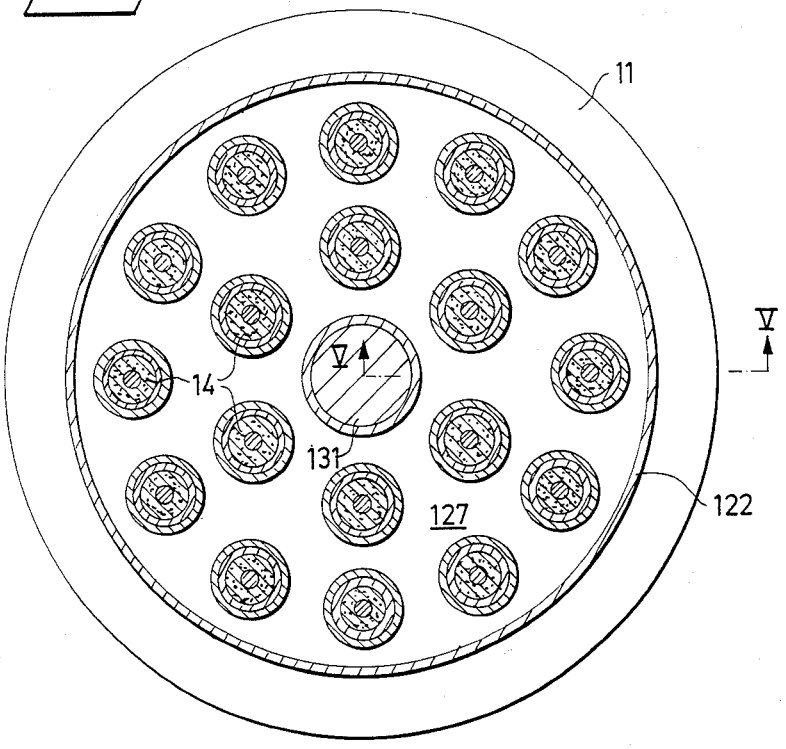
FIG. 4 is a section through a third embodiment of a unit in accordance with the invention.
Figure 5:
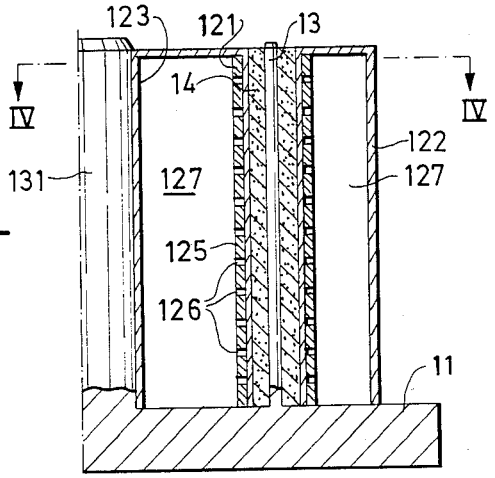
FIG. 5 is a section taken along the line V—V in FIG. 4.

Thus, in accordance with FIGS. 4 and 5, a plurality of cavities 14 may be arranged in one and the same press tool unit, the elastomeric jackets 121 of the cavities being pressurized with the aid of the press via the sleeve 122, and the hydraulic fluid 127, which can flow through the perforations 126 in the stiff supporting jackets 125, the pressurization thus being isostatic and substantially independent of the distance of the cavities 14 from the sleeve wall 122 of the unit. In the embodiment according to FIGS. 4 and 5, the central core 131 does not need to be stiff but may consist of a soft elastomer, for example.

An alternative moulding tool unit is illustrated in FIG. 3, and includes a base slab 11, carrying a central mandrel 13 coaxially surrounded by a thin elastomeric jacket 121, which in turn is surrounded by a sleeve 122 to form a closed space 123 therebetween. The space 123 is filled with a relatively soft elastomer 128.

The sleeve 122, as well as the hydraulic chamber wall 4 of the press, may consist of elastomeric material.

With the aid of the invention, the size of the mould cavity and its position in the unit will be essentially independent of the size of the pressing chamber.

An isostatic press with a jacket has been described above, with the latter exercising a radially inwardly directed pressure on the powder in the mould cavity of the unit and the central mandrel or core 13 exercising reaction forces against the powder. However, it should be quite clear that the inventive concept also includes the exercise of pressure which is radially reversed, i.e., that by an implementation corresponding to the jacket wall of the illustrated press, the envelope surface of the core or mandrel is caused to exert an active pressing pressure against the powder cavity while the press jacket possibly only exerts reaction forces.

Similarly it should be clear that the core or mandrel 13 in the embodiment illustrated on the drawing can be excluded if so desired. Even if the mandrel/core is normally made from stiff material to define a surface of the pressed body well, it should be clear that the core can be made from an elastomer to facilitate removal of the pressed body and/or actively or reactively exercise a pressing pressure against this surface of the pressed body.

I claim:

1. A molding system for semi-isostatic compaction of powder, said system including a hydraulic press and a mold unit positionable in a chamber of said press, said mold unit comprising:

an elastomeric jacket defining a cavity for containing the powder;

a sleeve sealingly joined to said elastomeric jacket, said sleeve and said elastomeric jacket defining a cavity; and a pressure transferring medium in said cavity for transmitting pressure acting upon said sleeve to said elastomeric jacket.

2. A unit as claimed in claim 1, characterized in that the sleeve comprises an elastomer.

3. A unit as claimed in claim 1, characterized in that a stiff, perforated metal jacket is arranged to support the elastomeric jacket in a direction towards the sleeve.

4. A unit as claimed in claim 3, characterized in that the pressure translating medium is a hydraulic fluid.

5. A unit as claimed in claim 1, characterized in that the isostatic pressure translating medium is an elastomer with a hardness which is less than the elastomeric jacket.

6. A unit as claimed in claim 2, characterized in that a stiff, perforated metal jacket is arranged to support the elastomeric jacket in a direction towards the sleeve.

7. A unit as claimed in claim 2, characterized in that the isostatic pressure translating medium is an elastomer with a hardness which is less than the elastomeric jacket.

* * * * *